US006349829B1

(12) United States Patent
Matheis et al.

(10) Patent No.: US 6,349,829 B1
(45) Date of Patent: Feb. 26, 2002

(54) CARD PACKAGE ASSEMBLY AND METHOD OF MAKING SAME

(75) Inventors: Mark A. Matheis, Frederick; John L. Wantz, Thurmont; Robert M. Brown, Emmitsburg, all of MD (US)

(73) Assignee: Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/496,203

(22) Filed: Feb. 2, 2000

(51) Int. Cl.[7] ..... B65D 75/00
(52) U.S. Cl. ..... 206/449; 206/39
(58) Field of Search ..... 206/39, 39.4–39.6, 206/449, 454, 45.24, 463; 283/56, 61, 904, 82; 235/493; 53/452, 453, 455, 467; 229/71, 92.8

(56) References Cited

U.S. PATENT DOCUMENTS 2,209,601 A * 7/1940 Heywood ..... 229/71
2,860,826 A * 11/1958 Cooke ..... 229/72
3,173,540 A * 3/1965 Lapides ..... 206/463
3,382,970 A * 5/1968 Sellors ..... 206/45.24
3,726,471 A * 4/1973 Kalb ..... 229/92.8
3,773,251 A * 11/1973 Hadick ..... 229/92.8
3,999,700 A * 12/1976 Chalmers ..... 229/71
4,768,811 A * 9/1988 Oshikoshi et al. ..... 283/82
5,650,209 A * 7/1997 Ramsburg et al. ..... 229/71
5,842,629 A * 12/1998 Sprague et al. ..... 229/71
6,109,439 A * 8/2000 Goade, Sr. ..... 206/454

* cited by examiner

*Primary Examiner*—Jim Foster
(74) *Attorney, Agent, or Firm*—Fitch, Even, Tabin & Flannery

(57) ABSTRACT

A card package is provided with a viewing window covered by a transparent, plastic window sheet or patch allowing a viewer to see the entire card or a portion thereof while the plastic window patch protects the card against damage. The card package may be in the form of a "C"-folded package assembly having an integral interior end panel, an exterior end panel, and intermediate end panel with the card positioned interiorly between the exterior panel and the intermediate panel. Also, the card package may have an "A," "V" or "Z"-folded configuration. A transfer tracking strip may be releasably mounted on a panel for removal where the card is a phone package card. A transfer tracking strip may be releasably mounted on a panel for removal where the card is a phone package card. The preferred method of manufacture produces the card assembly from a printed web of sheet material, plastic window patches, a card with the web being folded to form the panels and with the card and patch being adhered to panels of the assembly.

28 Claims, 11 Drawing Sheets

Fig. 14
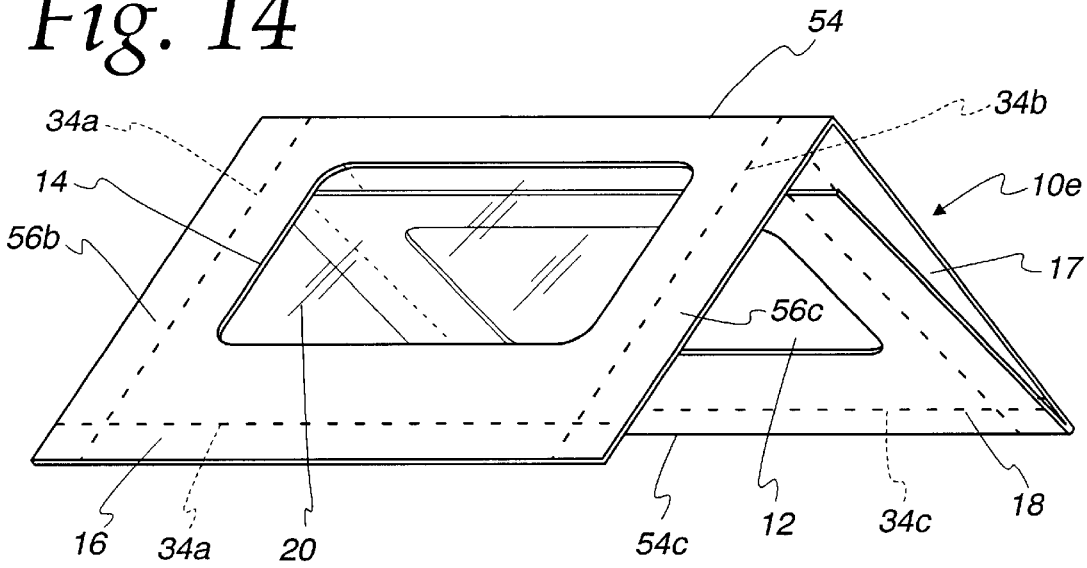
Fig. 14A
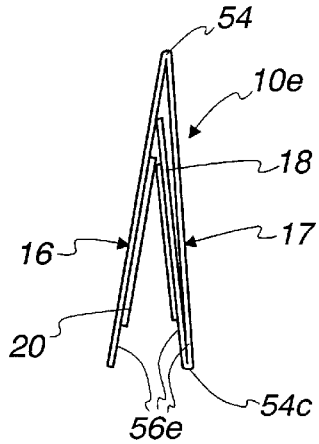
Fig. 15
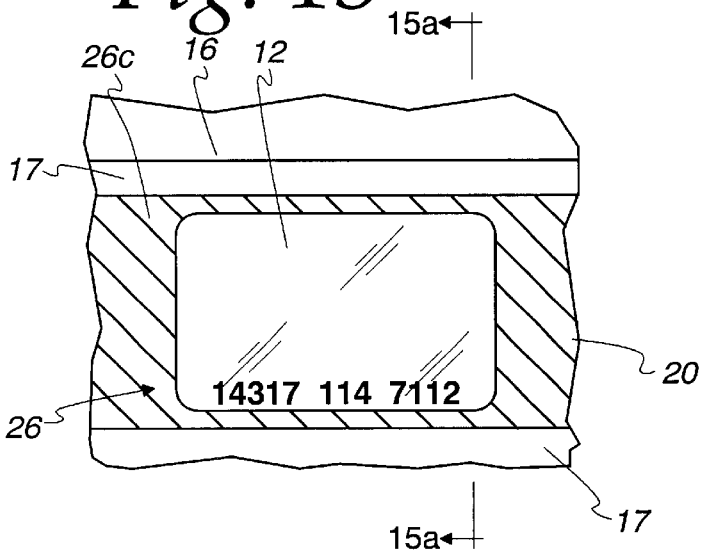
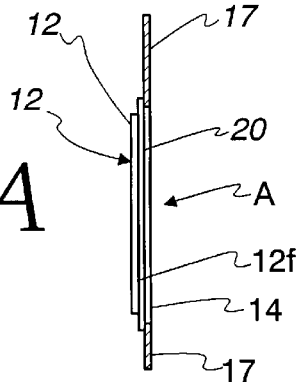
Fig. 15A

CARD PACKAGE ASSEMBLY AND METHOD OF MAKING SAME

FIELD OF THE INVENTION

This invention relates to mounting and presenting cards such as gift cards, telephone cards, etc., in a package assembly particularly for point-of-sale applications, and to a method of manufacture of a package assembly containing a card therein.

BACKGROUND OF THE INVENTION

Various cards, such as gift cards and telephone debit cards of a predetermined value and the like, are sold and dispensed to purchasers in high volumes, typically at a point-of-sale location in a retail store. In other instances, credit cards, debit cards, or identification cards are delivered to a person within a card package which securely mounts and protects the card and covers portions of the card containing confidential information. In most instances, the package assembly is aesthetically pleasing with indicia on the packaging informing the purchaser of the nature of the card and its value with a window allowing the purchaser to view the card or a portion thereof. For example, a gift card may be sold by a video chain store denominating the value of the card to the receiver while advertising the video store and a certain movie video that can be purchased or rented with use of the card. Similarly, a phone debit package will show the monetary value of the card, usually for minutes of long distance calling, as well as a replica of the card and access to certain information needed for tracking the card after its purchase. Typically, the card package is made of paper or paperboard and the card is made of a stiffer or thicker material of plastic and, in some instances, of paper.

Card packages are usually folded sheets of paper material folded into a variety of known fold configurations such as "A," "V," "C," "Z," etc., with automatic folding equipment with the panels adhered to one another to complete the package. In the "A" and "V"-folded configurations, there are usually only two panels connected to one another by a common fold line at one end of the package and with the other side edges of the panels adhered to each other with an adhesive pattern. In the "Z" fold configuration, the sheet material is folded into three panels with two fold lines at the opposite ends of the package and with one internal panel between front and rear panels of the package. Access to the card within the package is usually with an opening-facilitating (tear) strip defined by one or more lines of weakness in the package material. Various indicia indicate how to remove the tear strip and a pull tab on the tear strip may be provided to assist the purchaser in gaining access to the card. The sheet material for the package is often die cut, such as to form windows or openings to view the card or information on the card and perforations are provided to form a tracking strip or tear strips. Reinforcing or release tapes may also be adhered to the sheet material when making a reinforced tracking strip to facilitate removal of the tracking strip from the package and a subsequent adherence of the tracking strip into a merchant=s journal or the like, such as for a long-distance minutes phone card.

There is a need for an inexpensive package assembly for mounting and presenting cards that has a window to allow the viewers to see the card through a transparent plastic window or window patch that covers the card, thereby preventing removal of the card and scratching or other damage to the card before the sale and removal of the card from the package.

It will be appreciated that gift and phone cards often have only a small value; and hence the cost of manufacture of the card package and assembling the card therein must be kept low and should be highly automated using automatic web handling equipment with the individual package sheet blanks being severed from the web prior to being formed into the final package assembly. Preferably, gluing, die cutting, perforations, placing of the cards and adhering the same to the web are done at various stations as the web continuously travels through the machine at a relatively high speed. Also, the folding of the sheet and adhering of the sheet panels into the package configuration is done with a high-speed automatic folding machine.

SUMMARY OF THE INVENTION

In accordance with the present invention there is provided a new and improved card package having a viewing window which is covered by a transparent, plastic window sheet or patch allowing the viewer to see the card or a portion thereof while the plastic window patch protects the card against damage. That is, the card is encased behind a visible, transparent window of plastic to remain clean and undamaged while exposed and in full view to the purchaser. This is achieved by separating a window piece of plastic from an elongated plastic strip or web and adhering the separated patch to the package sheet material to cover the cut-out window in the package sheet material. Preferably, an adhesive pattern is formed on the transparent window patch to adhere to the sheet material about the cut-out window with the adhesive pattern being hidden from view and within the interior of the final folded package assembly. The preferred transparent window strip or tape, from which the window patches are made, is a rolled tape and it may be one of several clear plastic materials such as MYLAR®, styrene, polyethylene, or polystyrene.

In another embodiment of the invention, the entire plastic window strip is covered with adhesive and the card is adhered to the window adhesive which, in turn, is adhered to the packaging material.

The preferred method of manufacture of producing the card package assembly comprises providing a printed web of sheet material to form into a folded package; providing cutouts in the traveling web to form a window for each folded package to view the card or a portion thereof; providing a clear transparent strip of window patch material; severing individual window patches from the strip and placing the window patches over the cut-out windows in the sheet material; adhering the window patches to the sheet material; mounting the card on the sheet material with the card aligned with the cut-out window to be viewed; applying adhesive to the sheet material web that will hold panels together in the final package assembly; severing each package sheet with a card thereon from the web; folding the severed sheet into a folded configuration having at least two panels and a fold line; and adhering the panels to one another to form the final package with the card being located between the panels and visible through the window patch. Manifestly, the order of these several operations in this method may be varied from that described above, if so desired.

In the preferred method, a perforating of the sheet material is performed to make a line of weakness and to form a tear strip in one of the panels to allow access to the card upon removal of the tear strip.

Also, patterns of adhesive are formed on the non-folded side edges of the package panels and the side edges of the panels are adhered to one another to form a closed package enclosing the card in the closed package to prevent unauthorized removal of the card from the package assembly.

In one form of the invention, the folding operation involves a single fold in the sheet material and folding the sheet material into an "A" or "V"-folded configuration for the final package assembly. In another form of the invention, the folding operation involves forming two folds in the sheet material and folding the three panels into a "Z"-folded configuration. Also, the three-panel configuration may be formed into a "C" configuration by folding and adhering the third panel between the first and second panels. In another embodiment of the invention, the sheet material is provided with lines of weakness to allow bending of flanges to form a bottom-standing feature or display platform for standing the card package assembly upright.

In instances where the card is a phone card, a tracking strip is releasably adhered to web of sheet material for removal after purchase. A removable release strip may be provided on the tracking strip to uncover an adhesive patters to be used by the merchant to adhere the tracking strip in his journal. In card packages, such as a gift or phone card package, another cut opening may be made in a sheet material panel to allow viewing of indicia on a back interior side of the card, such as for verifying the value of or identity of the card.

BRIEF DESCRIPTION OF THE DRAWINGS

As shown in the drawings for purposes of illustration:

FIG. 14 is a perspective view of a three-panel sheet of FIGS. 13 and 13A, which is folded into a "C"-folded configuration;

FIG. 14A is an end-elevational view of a "C" configuration package assembly;

FIG. 15 is a fragmentary view of a window patch having adhesive across its entire rear face and adhered to the rear face of a card having a front face viewable through a window;

FIG. 15A is a cross view through line 15A—15A on FIG. 15;

DESCRIPTION OF THE PREFERRED EMBODIMENTS

Figure 8:
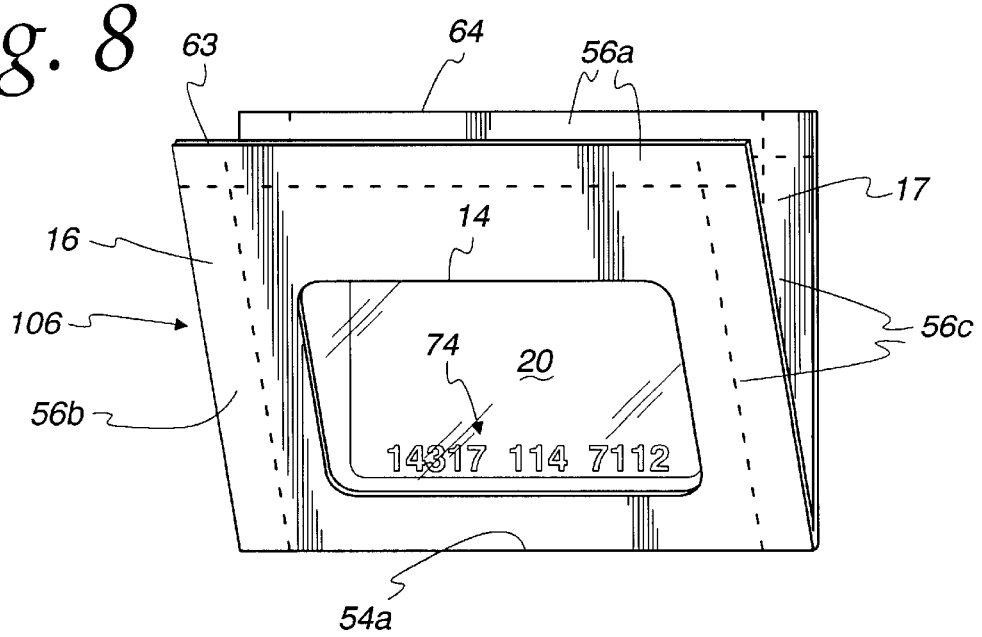
FIG. 8 is a perspective view of the partially-folded "V" configuration of the sheet material and card of FIG. 7.

Referring now to the drawings for purpose of illustration, the invention is embodied in a card package or package assembly 10 in which is mounted a card 12 that is viewable through a cut-out window 14 in a first or front panel 16 of the package assembly. Usually, the cut-out window is not covered and this exposes the card to damage or unauthorized removal. In other instances, there is no cut-out window and only a printed simulation or picture of the card is provided on the exterior surface of the package to inform the viewer of the appearance of the card inside of the package. From a sales and marketing standpoint, the card seller often wants to display the entire card or a substantial portion thereof in an aesthetically pleasing manner to enhance the sales appeal of the merchandise. Thus, there is a need for a protective, transparent window of plastic to cover the window opening to prevent unauthorized removal of the card through the window, and damage to the face of the card which is provided in a number of various folded, package configurations such as an "A"-folded configuration (FIG. 4); a "V"-folded configuration (FIG. 8); a "Z"-folded configuration (FIG. 10), a "C"-folded configuration (FIG. 14), etc., while using high speed, web and folding equipment.

The card 10 may be any kind of card, such as a gift card, phone card, identification card, credit card, debit card, etc., which are usually printed with indicia 74 (FIGS. 3 and 5) and are usually of a stiffer and thicker material than the web material that is formed into the final package. Usually, the web material is a thinner, less stiff paper material and the card 12 is made a thicker and stiffer plastic material. While the card is shown herein as being separately formed and discreet from the package sheet material, the card could be die cut in the web material and then detached from the web material after the package is opened. Herein, the card 12 is described as a separate, discreet card 12 that is releasably attached to the web material or, in the embodiment of FIGS. 13 and 14, releasably adhered to a coated face of the window patch 20.

Figure 1:
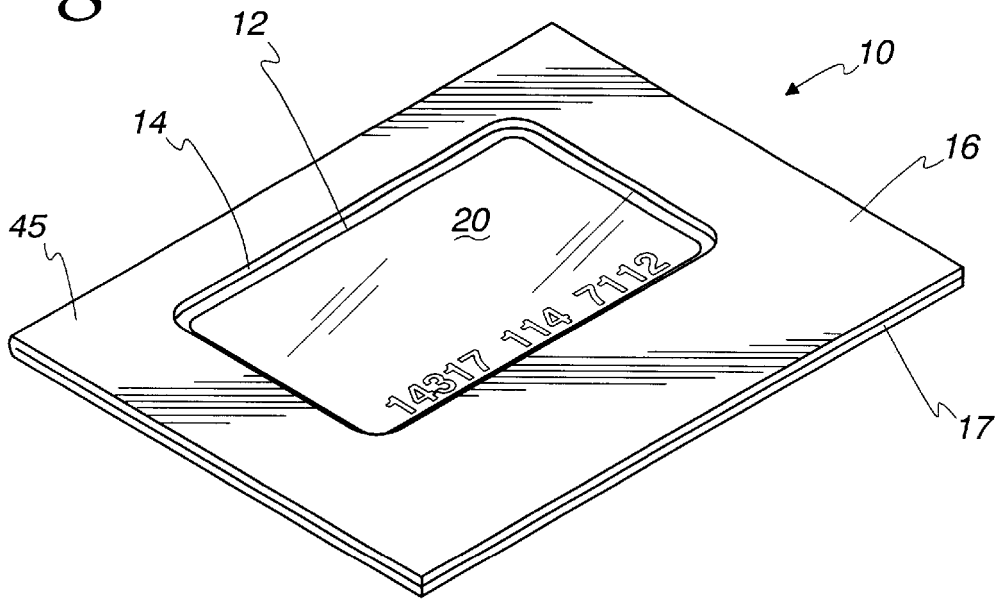
FIG. 1 is a perspective view of a card package assembly having a transparent plastic piece covering a window and card within the package with the card viewable through transparent plastic, covered window and constructed in accordance with one embodiment of the invention.
Figure 2:
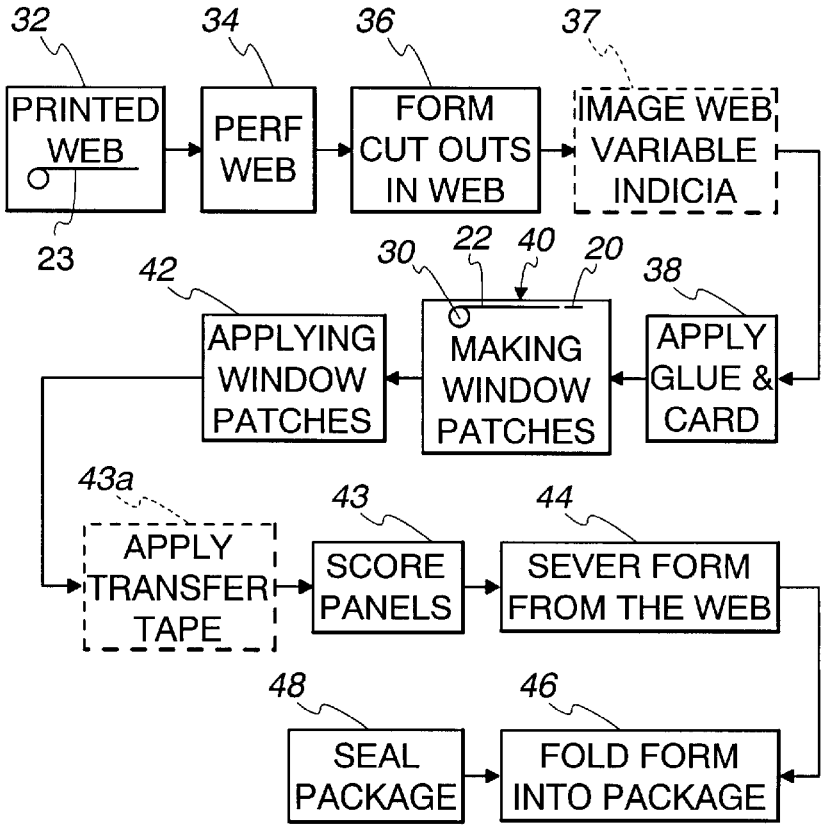
FIG. 2 is a schematic diagram illustrating various method operations that can be performed to make the card package assembly.
Figure 3:
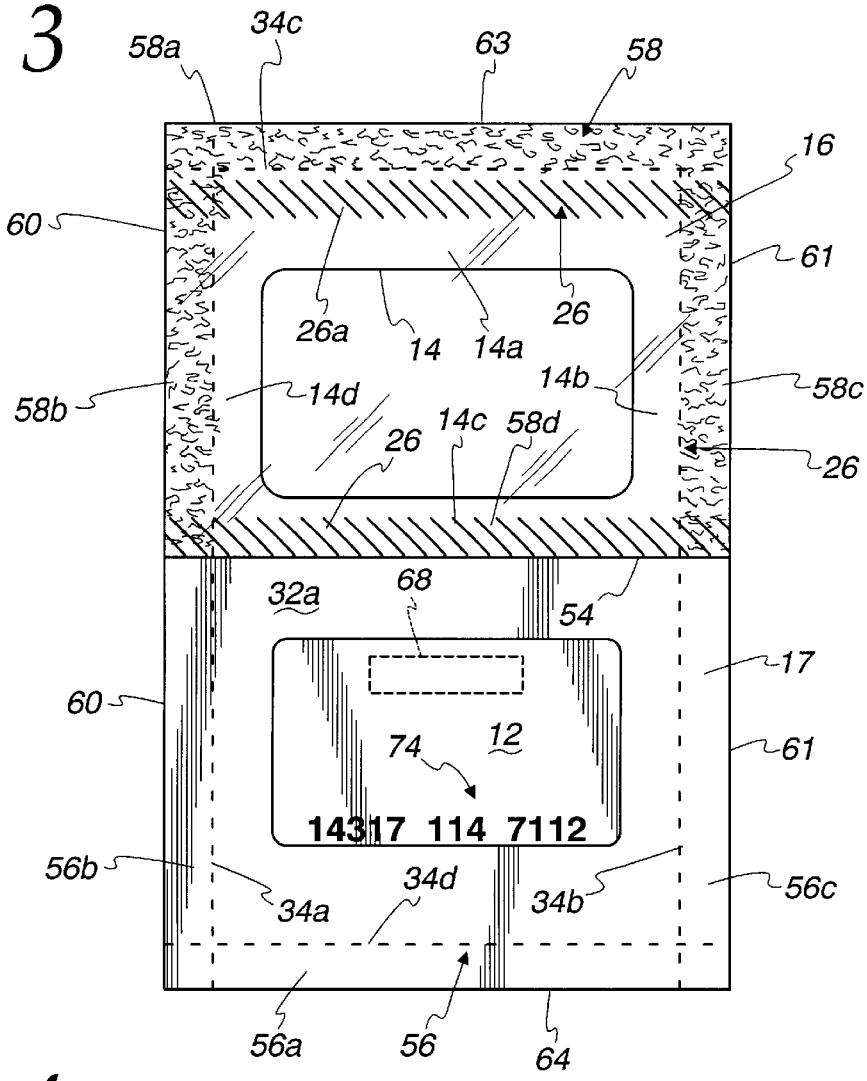
FIG. 3 is a plan view of an upper face of a sheet severed from a web and having a card mounted thereon.

In accordance with the present invention, the card 12 is exposed to the viewer through a clear plastic piece or patch 20 covering the cut-out window 14 while the clear plastic patch 20 protects the card from damage and against unauthorized removal from the package assembly 10. The window patch is formed by severing a piece of a plastic web or tape 22 and adhering the window patch to a web 23 which is illustrated diagrammatically in BOX 32 in FIG. 2, of package sheet material 24 that will be folded to form the final package assembly. Preferably, an adhesive pattern 26 is provided on either the window patch or the sheet material to adhere the patch to the sheet material. As will be explained, the patch 20 is placed on the top face 32*a* in the FIGS. 3 and 4 embodiment and is adhered to and placed on the bottom face 32*b* of the sheet in the FIGS. 13 and 14 embodiment. In the FIGS. 3 and 4 embodiment of the invention, the window patch 26 has an upper edge (FIG. 3) adjacent the perforation line 34*c* and a lower edge adjacent the fold line 54. The window patch 20 extends, in FIG. 3, from left side edge 60 of the sheet 32 to the right side edge 61 of the sheet. The adhesive pattern 26 may take various forms, but in the FIG. 3 embodiment it comprises an upper horizontal line of adhesive 26*a* located above the top edge of the cut-out 14 and below the perforated line 34*c* and shown by a slashed line in FIG. 3. A second parallel line of adhesive 26*b* is located between the lower edge of the cut-out and the fold line 54. In FIG. 3, there is no window adhesive between the side edges of the cut-out window 14 and the adjacent edges 60 and 61 of the sheet 32. In FIG. 3, the lines of adhesive 26*a* and 26*b* are on the plastic window patch 20, which is then pressed against the sheet to adhere the window patch 20 to the sheet. Thus, the adhesive pattern 26 is being hidden from view of the viewer looking through the cut-out window. In another embodiment of the invention, an adhesive pattern 26*a* (FIG. 12) is across the entire face of the window patch 20 with the window patch being adhered to both the card 12 and to the package sheet material 24 about the window, as will be explained in greater detail hereinafter. The preferred window patch 20 is severed from a wound roll 30 (BOX 40) of plastic tape or strip 22 that is made of one of several clear plastic materials, such as MYLAR®, styrene, polyethylene or polystyrene that are transparent. The term "window patch" is not limited to any particular size or shape for the clear plastic material that covers the cut-out opening 14.

Briefly, the preferred method (FIG. 2) of manufacture of the card package assembly 10 comprises the providing of a printed web (BOX 32, FIG. 2) of packaging sheet material 29 and perforating the web (BOX 34) and making cut-outs (BOX 36) such as with a die cutter to form the window 14 in the web packaging sheet material at spaced intervals along the web; traveling the web forwardly through an adhesive applying station (BOX 38) and applying card by gluing it to the sheet 32 (BOX 38); providing a strip 22 of clear plastic and severing window patches 20 (BOX 40) from the strip; placing the window patches 20 (BOX 42) over the cut-out windows 14 in the web and adhering the window patches 20 to the web of package sheet material thereby covering the cut-out windows 14 in the sheet material; severing from the web a form (BOX 44) comprising a package sheet 32 with a card 12 and patch 20 thereon; folding the severed form into a folded configuration (BOX 46) having at least a first panel 16 and a second panel 17 joined to one another by a common fold or fold line 54; and adhering the panels (BOX 48) to one another to form the final card package assembly 10 with card 12 being located between the panels and visible through the window patch. The order of the above-listed operations in the method may be changed or reversed from the order described above, if so desired. The equipment used to form the final package assembly is conventional or it is adapted from conventional, commercially-available equipment and, hence, need not be described in detail herein.

The preferred method may also include a scoring operation (BOX 43, FIG. 2) on the web of package sheet material to form one or more lines of weakness and a tear strip 56 (FIG. 3) in one or more of the sheet panels to allow the package recipient, upon pulling the tear strip, to gain access to the card in the package assembly. In the preferred method, an adhesive pattern 58 is applied to seal the panels together in the final package. In FIG. 3, the adhesive pattern 58 is applied along side edges 60 and 61 of the respective panels and along the non-folded ends 63 and 64 of the panels to adhere the panels 16 and 17 to one another to encase the card within the package assembly. The adhesive pattern 58 is preferably applied either while the web is traveling through an adhesive applying station (BOX 38) or at an automatic folder 46 (BOX 46) that folds the severed sheet material form and forces the panels together to adhere to one another while in the folder. As will be explained in connection with several embodiments of the invention, the adhesive pattern 58 may be applied to both the top and bottom faces 32 and 32*b*.

When making a phone card package assembly, it is usual practice to add variable indicia to the web at a station (BOX 37) and to apply a transfer, tracking strip 64 (BOX 43*a*), such as shown and described in U.S. Pat. No. 5,667,247, may be releasably adhered to the web of sheet material for removal after sale of the phone card package assembly.

The term "indicia" as used herein refers to markings or indications made on the web of package sheet material or the card usually by a printing method, such as lithographic, flexographic, or other imaging methods.

A removable release tape may be provided on the tracking strip to cover an adhesive pattern 66 on the tracking strip. After removal of the tracking strip from the package, the merchant will remove the release strip and adhere the tracking strip to a journal with the adhesive of the adhesive pattern 66.

Also, in accordance with the method of manufacture of a gift or phone card package, a second cut-out opening 68 may be die cut in the traveling web of sheet material 24 to allow viewing of indicia on the rear face of the card from the outside of the package. This second opening or window 68 may also be covered by a clear plastic window, if desired. Usually, this second window is very small to allow verification of a number or value on the card, as compared to the first window 14 which allows a view of the entire card. In FIG. 3, the window 14 is in the top panel 16 and cut-out opening 68 is the panel 17 beneath the card 12.

Figure 2A:
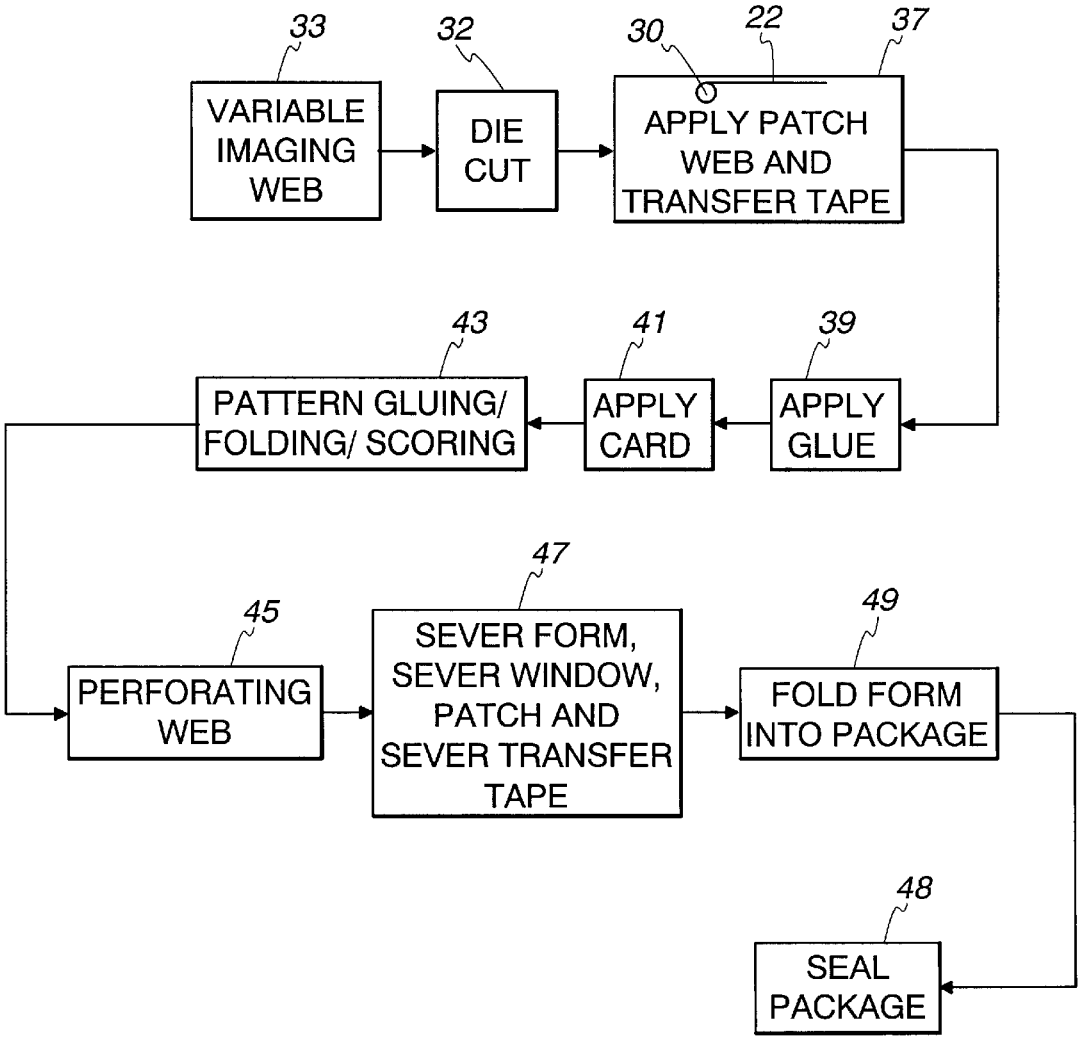
FIG. 2A is schematic diagram illustrating another method to make the card assembly.

Another method in accordance with a preferred embodiment of the invention will now be described in connection with FIG. 2A. A static or preprinted web is fed into a variable imaging station 33 where any kind of variable imaging is placed on the web. The web moves through a die cut station 35, at which dies cut the web to form the windows 14 in the web and the cut-out material is removed from the web. The continuous web 22 of patch material is then applied at BOX 37 generally from a roll of the web. Transfer tape is also applied to help open the final package. Then, glue is applied to the web to adhere the card at BOX 39 and the card is applied at BOX 41 and adhered to the preprinted web. Pattern gluing and folding/scoring then occurs at BOX 43. Perforating of the entire package web is then done at BOX 45. The card bearing web is severed, at BOX 47, to form an individual package. The severed package is then folded at BOX 49 to form the "V," "C," "Z," etc. form of package assembly 10. Preferably, the transfer and window patch materials remain as continuous web, respectively, until each package is severed at BOX 47.

The preferred card package assemblies and methods of making the same will now be described in greater detail. Referring now in greater detail to a first embodiment of the invention, the final package 10 is an "A"-folded configuration (FIGS. 4 and 6) having the first and second panels 16 and 17 joined at the top end by a fold line 54 that hinges the panels to one another. The first or front panel has the window 14 covered by the plastic patch 20 which is adhered to an upper inside face 32*a* of the package sheet 32 and the card 12 is also adhered to the upper inside face 32*a* of the package sheet 32. When the front panel 16 is adhered to and sealed to the rear panel 17, as best seen in FIG. 6, the card 20 is shown as being smaller in size than the size of the window thereby leaving a window border 14a about the four sides of the card 12 which allows viewing of the entire card as well as the surrounding portion of the face 32*b* of package panel 17.

Figure 4:
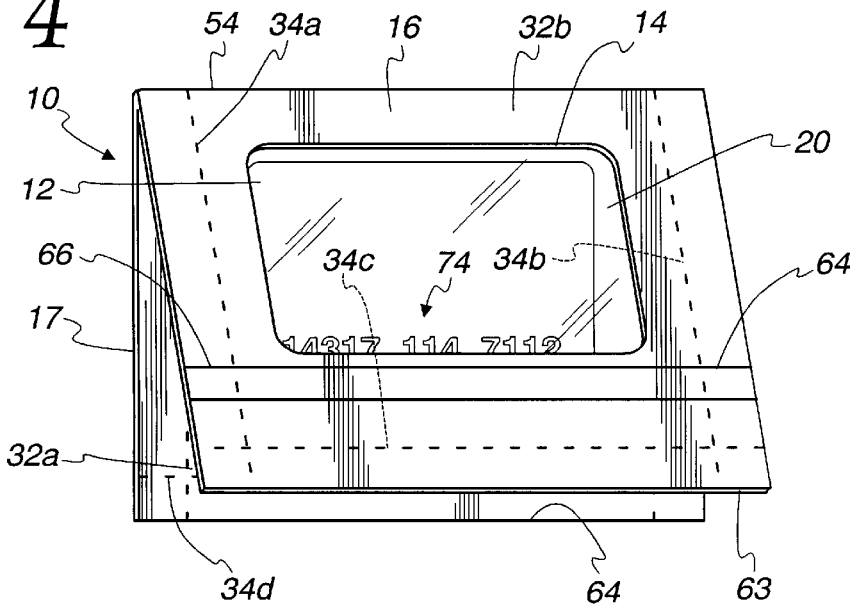
FIG. 4 is a perspective view of a partially-folded sheet of FIG. 3 being formed into an "A"-folded configuration.

The package is sealed with the card 12 inside by an adhesive pattern 58 which is on the top face 32*a* of the sheet, as viewed in FIG. 3, on the face 32*b* of the sheet. By way of example, the adhesive pattern 58 extends along and parallel to the top end 63 of the sheet as a continuous or strip of adhesive 58*a* that is about one-half inch in width. Herein, it is preferred to extend the adhesive pattern 58 as side strips 58*b* and 58*c* down 30 along the side edges 60 and 61 of the first panel 16 and also as a strip 58*d* along the bottom of the window. The bottom adhesive strip 58*d* is similar in size and parallel to the top adhesive strip 58*a*. The bottom adhesive strip 58*d* extends between the bottom edge of the cut-out, as seen in FIG. 3, to about the location of fold line 54. When the first panel 16 having the window 14 is folded down, as seen in FIG. 4, this adhesive pattern 58 will bring all four of its adhesive strips 58*a*–58*d* into engagement with the face 32*b* of the second panel 17, thereby sealing the package about the two vertical sides and about the bottom side. The top side of the package is sealed by the integral fold line 54 in the sheet. Thus, the card is seated within the package assembly 10 and unauthorized access to the card is denied.

To gain access to the card 12 sealed inside the package assembly, one or more tear-off strips 56 are provided to be torn from the package. In the embodiment of FIGS. 3–6, there are three tear-off strips including a bottom or end tear-off strip 56*a* and a pair of opposite side tear-off strips 56*b* and 56*c*. These tear-off strips are defined by lines of weakness in the sheet, and preferably are lines of perforation made in the web at BOX 34 (FIG. 2). Herein, a pair of parallel lines of perforations 34*a* and 34*b* are made in the sheet and extend along and parallel to the respective side edges 60 and 61 of the sheet. By way of example only, the illustrated perforations 34*a* and 34*b* are located about one-half inch inward from their respective side edges 60 and 61. A pair of lines of end perforations 34*c* and 34*d* may also be provided at ends of the sheet adjacent the top end 63 and the bottom end 64 of the sheet. These perforations 34*c* and 34*d* are in lines parallel to the ends and are located about one-half inch from the respective upper and lower ends of the sheet, in this illustrated example of the invention. If desired, one or more pull tabs may be die cut into a panel sheet and instructions are printed on the package informing the user to tear off the tear strips to open the package. Manifestly, various different options may be provided to open the package than the tear strips described. Also, the horizontal tear strips 34*c* and 34*d* may be replaced by a simple horizontal tear strip located intermediate the ends and in one panel 16 or 17 rather than in both panels as described herein.

Figure 5:
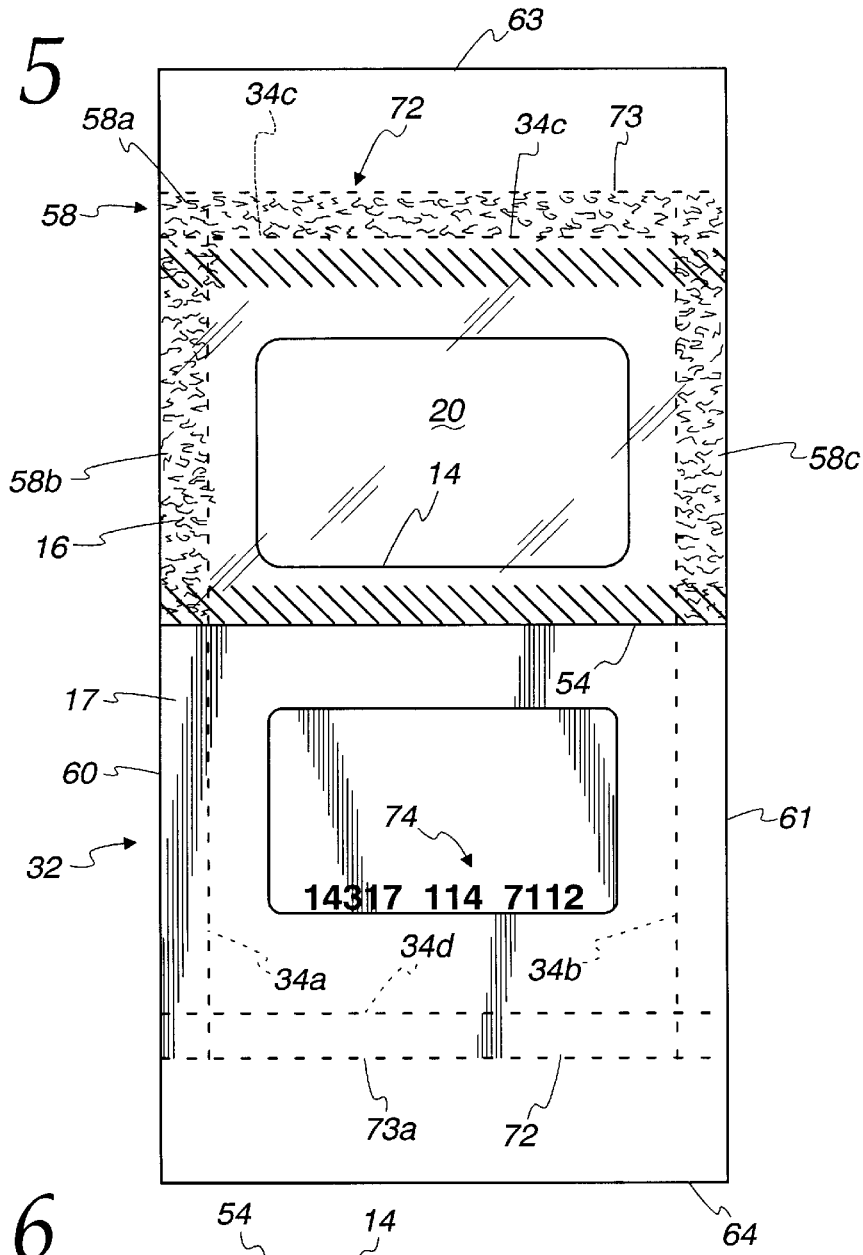
FIG. 5 is a plan view of a sheet having a card and with a bottom-standing feature for display of the package assembly.
Figure 6:
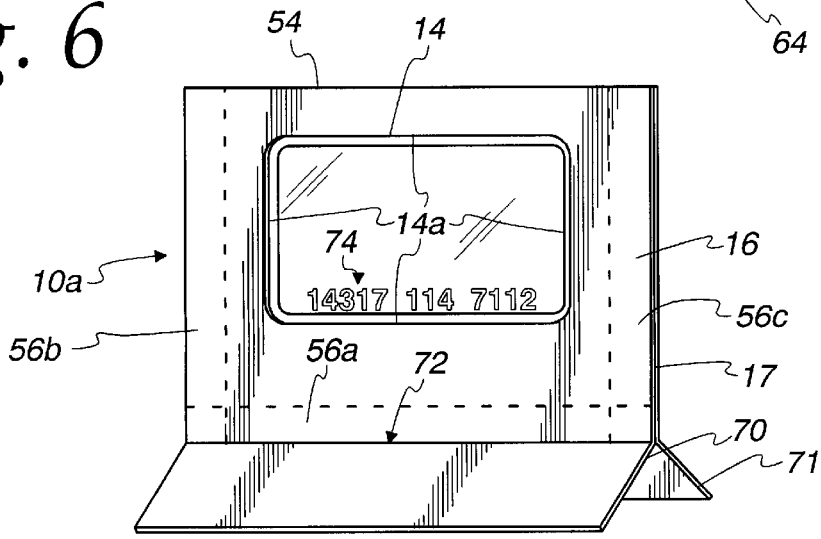
FIG. 6 is a perspective view showing the folded sheet of FIG. 5 with the bottom-standing feature erected into a display platform.

In the embodiment illustrated in FIGS. 5 and 6, a card package assembly 10*a* is made in the same "A" folded configuration described above in connection with FIGS. 3 and 4, but additionally has a stacking or display stand feature in the form of display tabs or end flanges 70 and 71 (FIG. 6) located at the bottom of the package and adapted to support the card package in an upright position. More specifically, the end flanges are bent outwardly from the plane of the vertical package to form a pair of inclined feet having lower edges for resting on a table, counter or other horizontal support surface. Herein, the end flanges 70 and 71 are in the form of strip tabs defined by fold lines 72. Herein, the fold lines 72 are made by folding the display tab flanges 70 and 71 along lines of weakness such as lines of perforations 73 and 73*a* in the respective panels 16 and 17. The sheet used for this display, standing feature package 10*a* is longer, e.g. two inches longer than the sheet for the package 10 of FIGS. 3 and 4. That is, a one-inch flange 70 is added at the top end of the sheet and a one-inch flange 71 is added at the bottom of the sheet with the lines of perforations 73 and 73*a* each being located one inch from the respective upper and lower ends of the sheet. These one-inch display tabs or flanges 70 and 71 will be bent outwardly by the merchant at the time of display to form the display platform at the bottom of the package to hold it upright, as viewed in FIG. 6. The line of adhesive 58*a* extends horizontally just above the flanges 70 and 71 and forms the tear strip 56*a* just above the flanges to hold the panel lower edges together just above the flanges.

Figure 7:
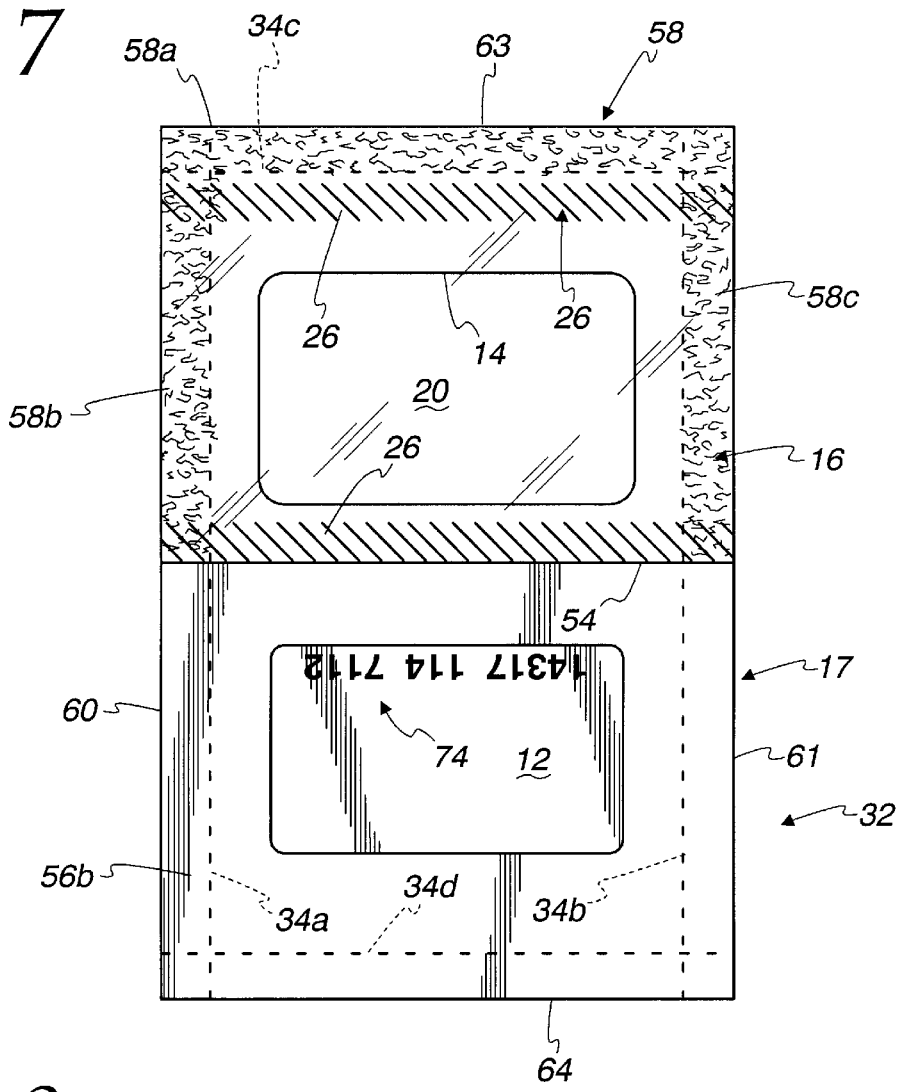
FIG. 7 is a view similar to FIG. 4 where the card is mounted to be viewed in the "V"-folded configuration of FIG. 8.

By folding the sheet form 32 with a fold line 54*a* (FIG. 8) at the bottom of the final package assembly, the package assembly 10*b* has a "V" configuration. In the "V" configuration, the card 12 is inverted from "A" configuration of FIGS. 4 and 6 and indicia 74 on the card is shown upside down in FIG. 7 on the sheet form prior to folding and then the indicia is right side up after folding and forming the "V"-folded configuration, card package 10*b*. The card 12 is protected by the clear plastic window patch 20. The adhesive pattern 58 in the package 10*b* is the same as in "A" package 10; and likewise the tear strips 56 are the same as in the package 10 and are defined by the lines of perforations 34*a*–34*d*.

Figure 9:
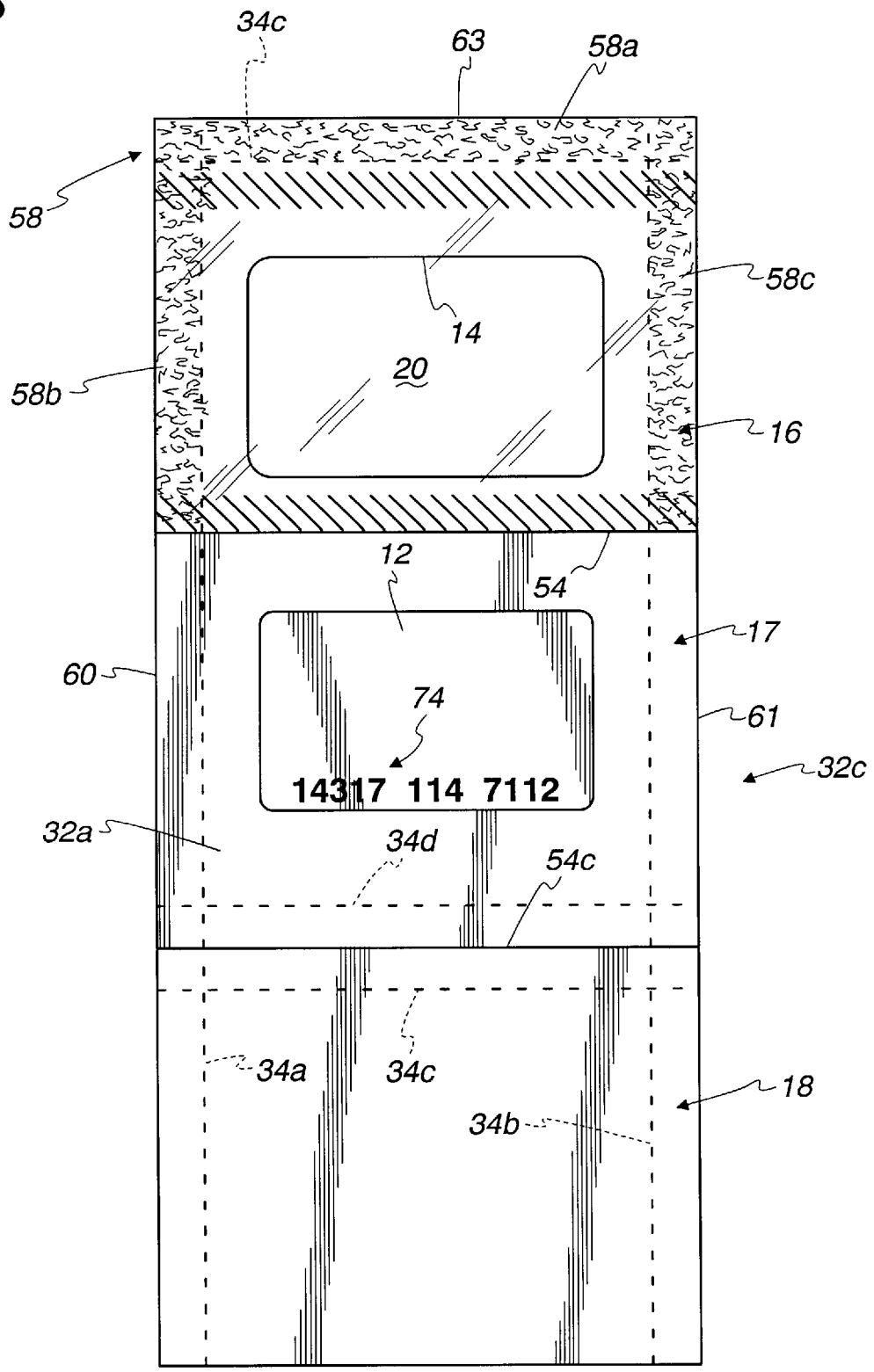
FIG. 9 is a plan view of a sheet having a card having three panels.
Figure 10:
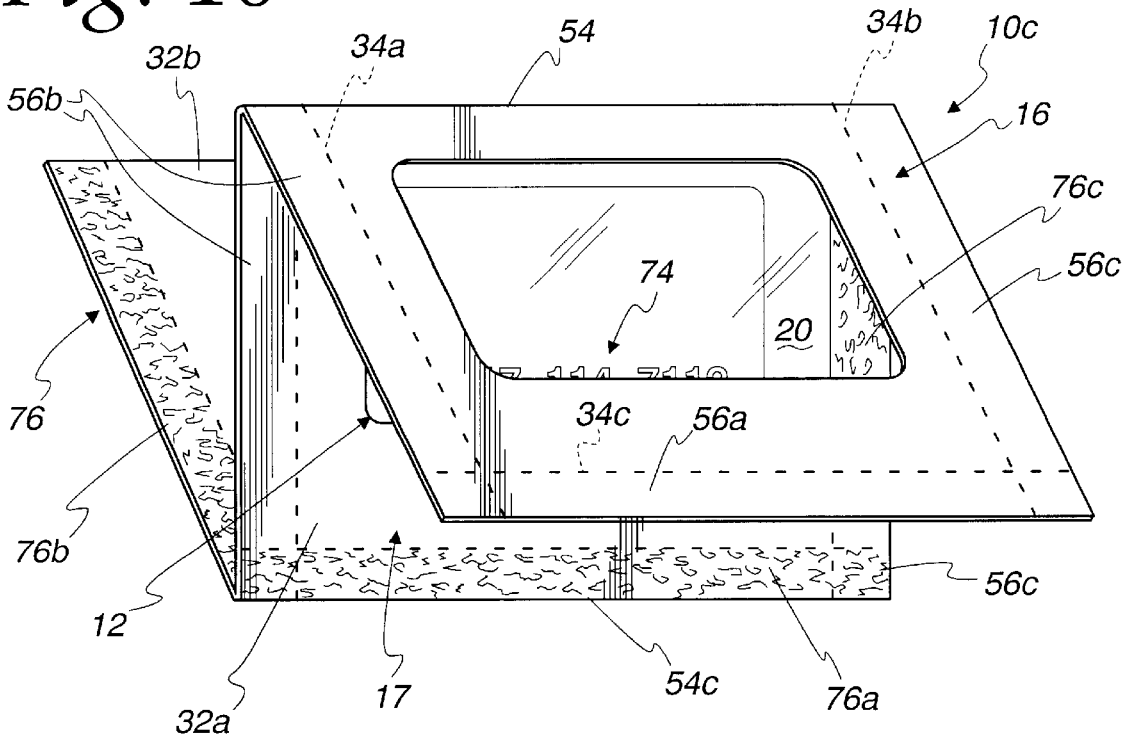
FIG. 10 is a perspective view of a "Z"-folded configuration of the sheet of FIG. 9 to show a card.

In accordance with the embodiment of the invention illustrated in FIGS. 9 and 10, a first "Z" configuration, package 10*c* is formed from a sheet form 32*c* that is made with three panels rather than two panels for the "A" and "V" shaped packages 10 and 10*a* described above. Herein, the die-cut window 14 is formed in upper or first panel 16 and the card is attached to the second panel 17 with a third panel 18 located at the end of the form opposite the first panel 16. In this instance, the third panel 18 is folded upwardly, behind the second panel 17 which bears the card 12. The third panel is joined to the second panel at a second fold line 54*c* that is parallel to the first fold line and parallel to end edges 63 and 64. In this embodiment, the transparent window patch 20 on the first panel 16 is hinged by the first fold line 54 at the top of the package to deny access to the card from the top of the package. To adhere panels 16 and 17 together to deny unauthorized access to the card 12, and adhesive pattern similar to the adhesive pattern 58 on the package form of the "A" package is used, i.e., with parallel side adhesive strips 58*b* and 58*c*, and end adhesive strip 58*a*. It is preferred to secure the third panel 18 to the second panel 17 by means of an adhesive pattern 76 applied to the underside or second face 32*b* of the package form 32*c*, as best seen in FIG. 10. Herein, the adhesive pattern 76 comprises a horizontal strip of adhesive 76*a* located just above the fold line 54*c* when the panel 18 is folded up as seen in FIG. 10. The adhesive pattern 76 also comprises a pair of side strips 76*b* and 76*c* of adhesive similar to the side adhesive strips 58*b* and 58*c*, but located on the opposite face of the form and on the third panel 18. The top end 62*d* of this illustrated embodiment is not secured by adhesive to the top edge of the second panel at or adjacent to the fold line 54, in this instance.

To provide authorized access to the card 12 in the "Z" package 10*c*, there are provided one or more tear strips 56*e*, 56*f* or 56*g*. These tear strips 56*e*–56*g* differ from the previously described tear strips in that there are three plies or pieces of the three panels 16, 17 and 18 in each tear strip rather than only two pieces from the panels 16 and 17 as in the "A" and "V" packages. Herein, the bottom tear strip is defined by a parallel line of perforations 34*c* in the panel 17 above the fold line 54 and a parallel line of perforations 34*e* located below the second fold line 54*c* as shown in FIG. 9, in the third panel 18, and the horizontal line of perforations 34*c* at the upper end of the first panel 16, as viewed in FIG. 9. Side perforations 34*a* and 34*b* extend longitudinally adjacent side edges 60 and 62 (FIG. 9) and also into the third panel 18 as continuations of the lines of perforations in the first panel 16 and second panel 17. Thus, the side tear strips also are three-ply. In this "Z" package 10*c*, the third panel 18 is shorter in length in the longitudinal direction so that the end edge 62*d* (FIG. 10) will be located below the fold line 54.

Figure 12:
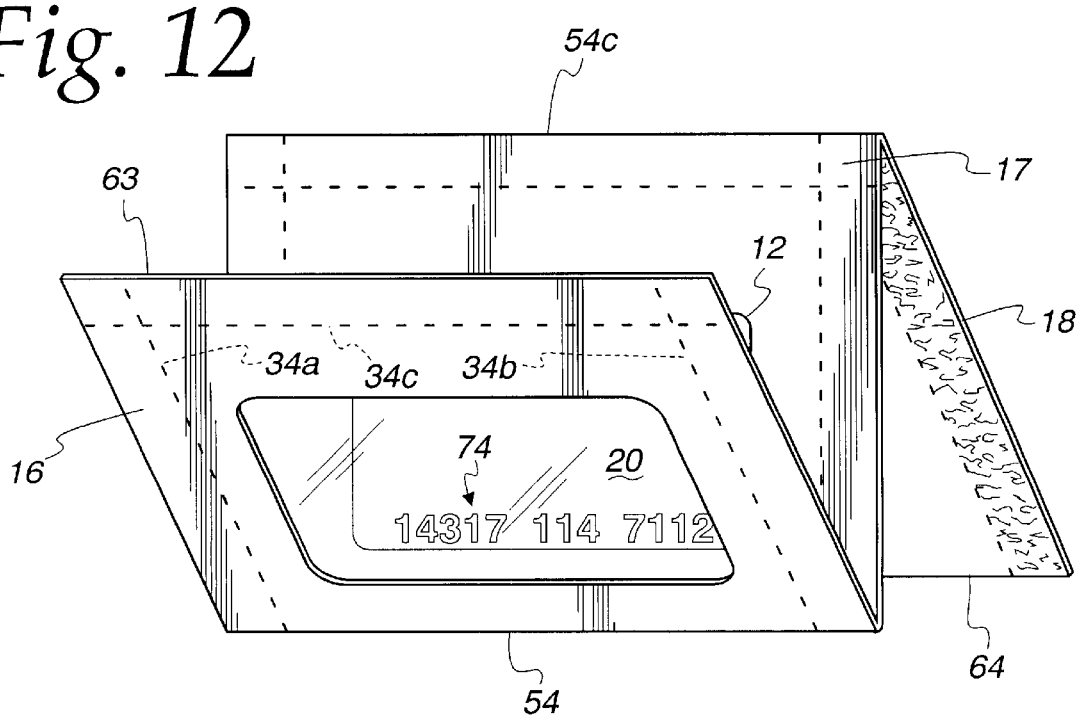
FIG. 12 is a perspective of a reversely-folded "Z" configuration made with the sheet and card shown in FIG. 11.
Figure 11:
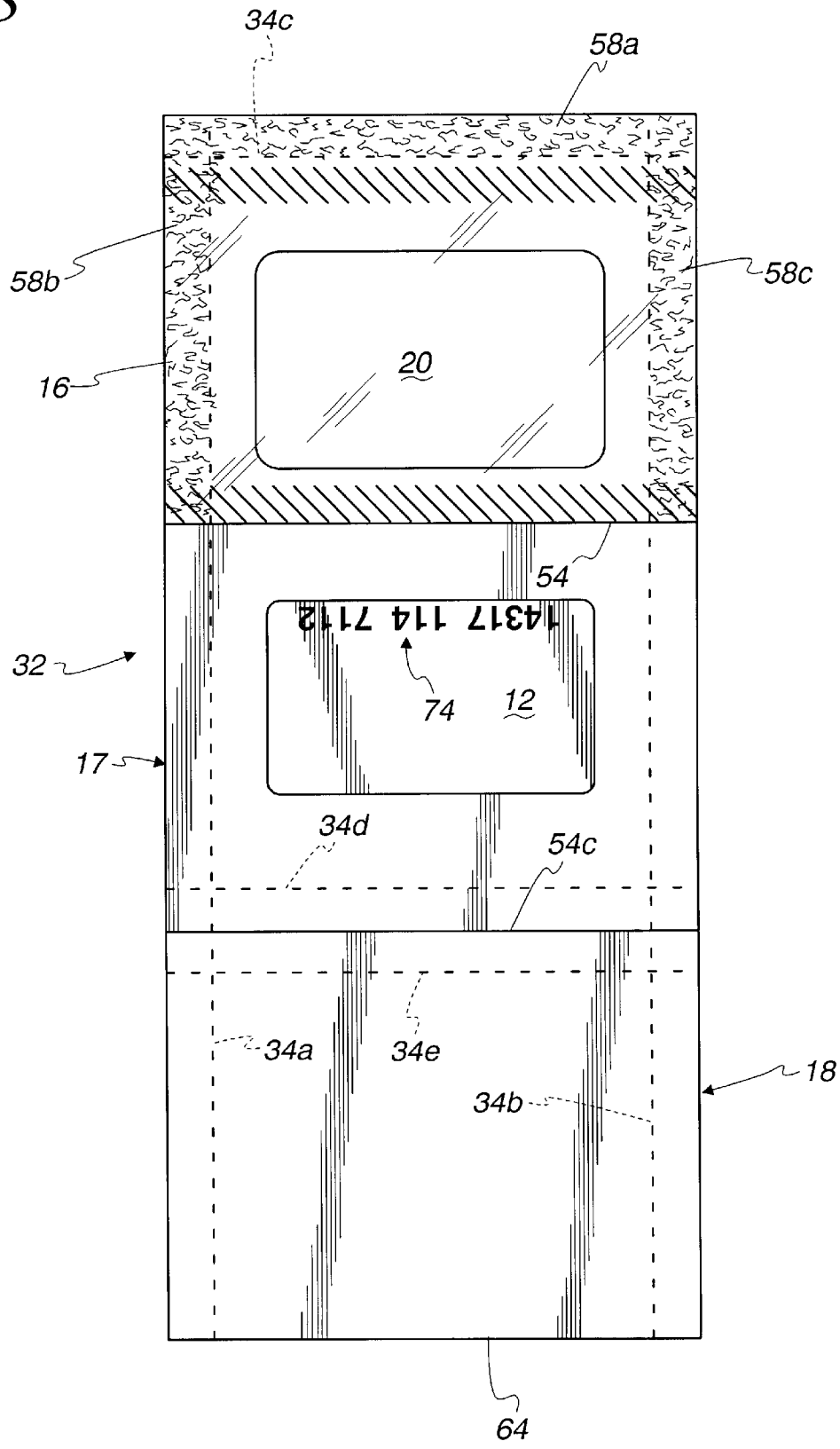
FIG. 11 is a plan view of a sheet having a card thereby to be erected into a reversely-folded "Z" configuration of FIG. 12.

Another "Z" fold package 10*d* will be described in connection with FIGS. 11 and 12 in which the fold line 54 between the first and second panels 16 and 17 is located at the bottom of the package rather than at the top as in "Z" packages shown in FIG. 10. The "Z" fold configuration of FIGS. 11 and 12 is 180° opposite to the "Z" fold configuration of FIGS. 9 and 10. The third panel 18 has its lower free end 62*d* located down close to the fold line 54 in the "Z" package of FIG. 12. The third panel 18 is shorter than the panel 16. The horizontal tear strip is located adjacent the bottom of the "Z" package 10*c* (FIG. 10) whereas the horizontal tear strip 56*e* is located adjacent the top of the "Z" package 10*d* (FIG. 12).

When making the "Z" package 10*d* shown in FIG. 12, the card 12 is applied to the package sheet 32 with its indicia 74 upside down in FIG. 11. Otherwise, the perforations 34, fold lines 54 and 54*c*, and adhesive patterns 58 are the same on both of the "Z" packages of FIGS. 10 and 12. It is only the manner of folding and the reorientation of the card that distinguishes the "Z" package of FIG. 12 from the "Z" package of FIG. 10.

Figure 13:
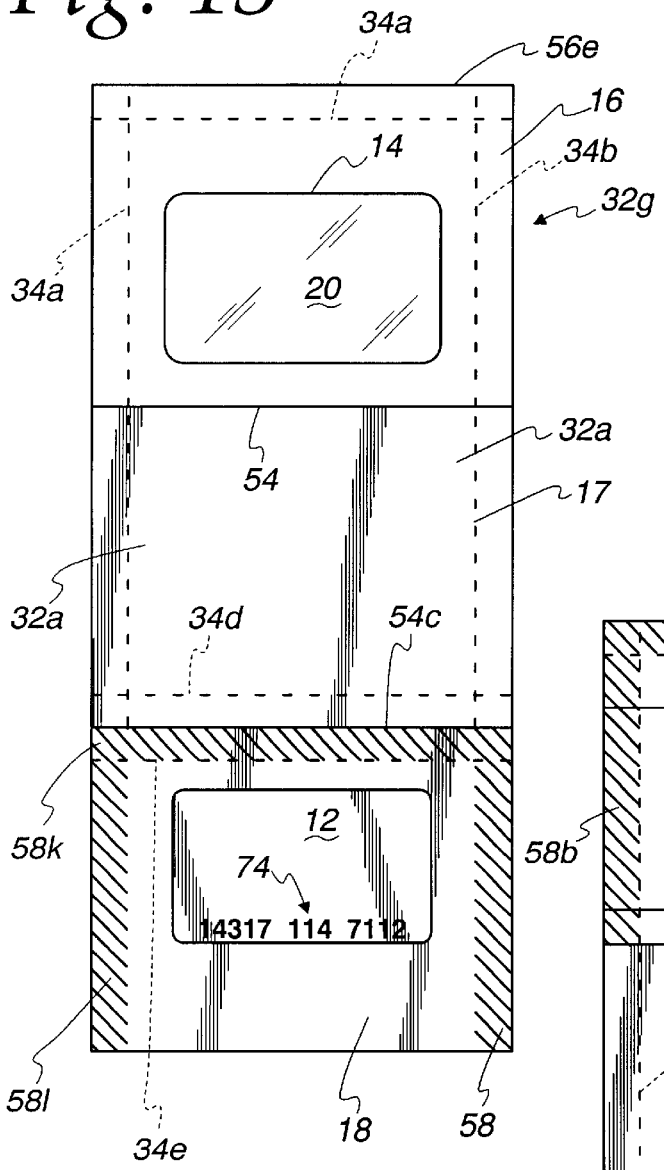
FIG. 13 is a plan view of one side of a sheet with a card and adhesive pattern thereon to be folded into a "C" package configuration of FIG. 14.
Figure 13A:
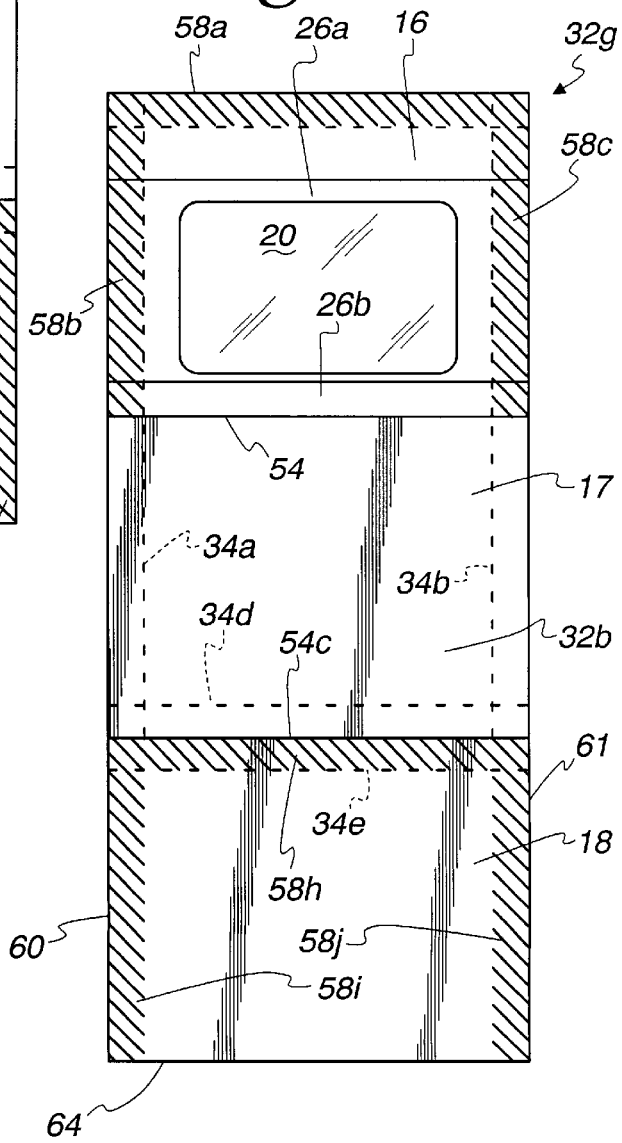
FIG. 13A is a plan view of the other side of the sheet of FIG. 13, showing a plastic window patch and an adhesive pattern on the other side of the sheet.

A three-panel form may also be folded into a "C" configuration, FIGS. 13 and 14 from a three-panel form 32*g* (FIGS. 13 and 13A). In this package sheet 32*g*, the card 12 (FIG. 13) is mounted on the third panel 18 at the bottom of the package form and on the first upper sheet face 32*a* and the cut-out window 14 is formed in the first panel 16. The plastic window patch 20 (FIG. 13A) is adhered to the opposite face 32*b* of the sheet 32*g* by parallel lines of adhesive 26*a* and 26*b*. The plastic patch 20 covers the card which is viewed through the window patch, as in the other embodiments of the invention.

In the "C" card package assembly 10*e*, the third, shorter panel 18 bearing the card 12 is folded upwardly between the first and second panels, as best seen in FIG. 14. In the folding operation, the third panel 18 is folded up about the fold line 54*c* between second panel 17 and third panel 18, and then outer, front panel 16 is folded down about fold line 54 to bring the window patch 20 down over the card 12.

Authorize access to the card 12 is obtained by tearing the lower tear strip 56*e* which is formed by the top perforation line 34*a* and the pair of perforation lines 34*d* and 34*e* adjacent to, opposite, and parallel to the second fold line 54*c*. The side perforation lines 34*a* and 34*b* extend along the respective sides of each of the three panels 16, 17 and 18 to form the three-ply side tear strips 56*b* and 56*c* for this "C" folded configuration package of FIG. 14, as was the case for the "Z" package 10*c* of FIG. 10.

To seal the three panels into the "C" configuration for the card package assembly 10*c*, a top adhesive strip 58*a* is applied to the opposite, lower face 32*b* (FIG. 13A) of panel 16 of the package sheet 32*g* as are the adhesive side strips 58*b* and 58*c*. These adhesive strips 58*a*, 58*b* and 58*c* will be adhered to side-edge portions of the first face of the third panel across both side edges and the bottom edge of the third panel adjacent to the sides and bottom edge of the card on the third panel.

The adhesive pattern 58 to seal the "C" package of FIG. 14 also uses lines of adhesive on the third panel 18 on its other or lower face 32*b* (FIG. 13A). More specifically, there is a horizontal line 58*h* of adhesive just below the fold line 54*c* joining the third panel 18 to the second panel. A pair of parallel lines 58*i* and 58*j* of adhesive parallel to the side edges 60 and 61 of the sheet extend between the free end 64 of the third panel 18 and fold line 54*c* joining the third panel to the second panel. As will be seen when comparing the upper face 32*a* of FIG. 13 and the lower face 32*b* of FIG. 13, there is similar adhesive pattern on the third panel 18 on each side thereof. More specifically, as best seen in FIG. 13, the upper face 32*a* of the third panel 18 has an adhesive pattern which includes a horizontal line 58*k* of adhesive on the top face 32*a* adjacent fold 54*c* of the third panel 18 and a pair of side edge adhesive lines 581 and 58*m* (FIG. 13) located along side edges 60 and 62 of the third panel 18 between the fold line 54*c* and free edge 64 of the third panel.

In the embodiment of FIGS. 15 and 15*a*, the card 12 has its front face 12*f* having indicia thereon adhered directly to the adhesive strip of window patch 20 and this patch strip supports the card, which is otherwise spaced from the sheet 32 by the border 14*a*–14*d* (FIG. 6) about the four sides of the window 14. In the other embodiment of the invention described above, the card 12 had its rear face glued as by a hot melt adhesive to a panel of the sheet at the time of applying the card to the web, as at BOX 38, FIG. 2. In the embodiment of FIG. 15 and 15A, the window patch 20 is coated with adhesive on its rear surface 20*r* and over the entire rear surface 20*r*. The front surface 20*f* on the window patch 20 is uncoated and the front face 20*f* is adhered to the sheet 32 by vertical lines of adhesive along both vertical sides 60 and 61 of the sheet within the vertical lines of perforations 34*a* and 34*b*. In the embodiment of FIG. 15 and 15A, window 14 may be in the second panel 17 and the window patch 20 and the card 12 will also be on the second panel. The shorter third panel 18 is folded up between the second panel 17 and the first panel in a "C" fold configuration for the package. A single, horizontal tear strip 58*a* may be formed adjacent the top end 63 of the sheet 32 by a perforation line 34*c* and side tear lines 58*b* and 58*c* may be formed by lines of perforations 34*a* and 34*b*. The fold line 54 will be at the top of the package 10 and the fold line 54*c* will be at the bottom of the package 10.

Figure 16:
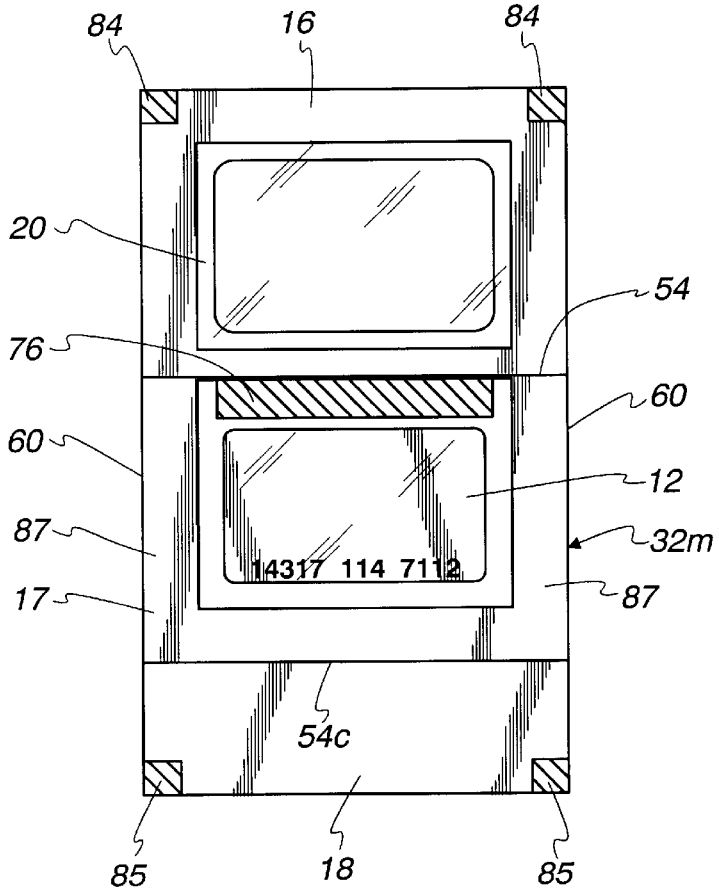
FIG. 16 is a plain view of one side of a sheet with an adhesive pattern thereon and a card mounted on a card carrier in accordance with a further embodiment of the invention.
Figure 16A:
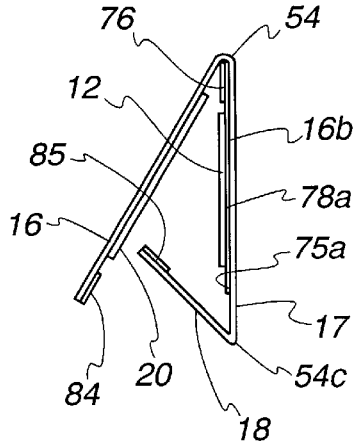
FIG. 16A is an end view of a "C" configuration package assembly having the card carrier and card of FIG. 16B therein.
Figure 16B:
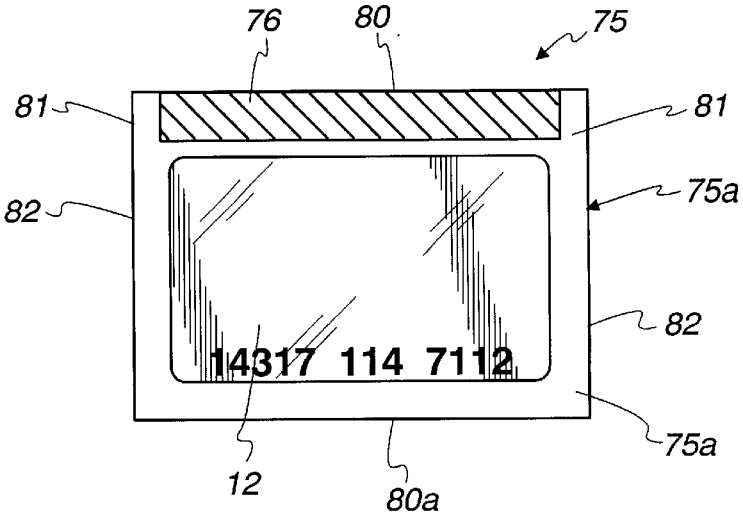
FIG. 16B is a plain view of a card carrier with a card mounted thereon.

In other embodiments of the invention shown in FIGS. 16–16B, and FIGS. 16–18B, respectively, the "C" configuration package 10 has a card 12 mounted on a card carrier 75 that is positioned interiorly of a folded three panel form 32*m* to expose the card through a window 20. In the embodiment of FIGS. 16–16B, the card carrier is preferably formed from a card carrier web which is severed from a web to form the individual card carrier 75. The card carrier 75*a*, which is shown in FIG. 16B, is a flat, rectangular card, e.g. about 4.25 inch by 3 inch with a strip of glue 76 applied to a carrier face 78. As will be explained in greater detail hereinafter, when a top panel 16 of the form 32*m* is folded about the upper fold line 54, as shown in FIG. 16A, the bottom surface of the top panel 16 will be adhered to the glue strip 76 on the card carrier 75*a*. The window 20 is formed by the plastic patch adhered to a top panel 16, in FIG. 16 or to a middle, second panel 17 of a three panel form 32*n* (FIG. 17). In the preferred embodiment of the invention, shown in FIG. 16–16B, the glue strip 76 is positioned parallel to and along a top edge 80 of the card carrier and terminates at a short distance or spaces 81 (FIG. 16B) from each of the side edges 82 of the card carrier. In this illustrated embodiment of the invention, the card 12 is adhered by glue to the carrier face, but it is to be understood that the card could be an integral portion of the card carrier that is separated from the remainder of the card carrier by the purchaser. Herein, the card carrier web has been printed or otherwise imaged on a back face 78*a* of the card carrier from the card carrier face. Manifestly, both faces of the card carrier can bear indicia. The illustrated card is centered between edges 80 of the card carrier and spaced 0.25 inch from a bottom edge 80*a* of the card carrier.

The card carrier 75*a* bearing the card is fed to and is positioned on the second panel between the upper fold line 54 and the lower fold line 54*c*. Glue spots 84 are applied to the opposite upper corners 84 of the top panel 16 to adhere the top panel to the bottom panel 18, as can be understood from FIG. 16A. The bottom panel 18 is shorter than the top and middle panels and is provided with glue spots 85 in its lower opposite corners to adhere the second panel to the middle panel at areas 87 on opposite sides of the side edge 82 of the card carrier 75*a*. The card carrier 75*a* is shorter than the width of the middle, second panel between side edges 60 of the middle panel to allow the glue spots 85 on the lower panel to adhere to the middle panel when the lower panel is folded over the card 12 and card carrier and about fold line 54*c*, as shown in FIG. 16B.

During the folding operation, the bottom panel 18 is first folded over the card carrier 75*a* and subsequently, the top panel 16 is folded over the top portion of the card carrier and over the top edge portion of bottom panel 18 to adhere glue spots 84 to the outer surface of the bottom panel to form the "C" configuration package assembly 10 having the card 12 enclosed therein. During the folding operation, the glue strip 76 adheres the card carrier to the facing surface of the top panel adjacent the fold line 54 and the adhesive spots 85 on the lower panel 18 adhered the third panel to the second panel at the spaces 87 on the second panel on opposite sides to the card carrier. Thus, the card carrier is held in position with alignment with the window patch 20 on the top panel to allow viewing of the card 12 through the window patch.

From the foregoing, it will be seen that there is a card package assembly having a window strip of plastic that is attached to a folded panel with the card being fully viewable through the window, yet protected by the plastic window patch. The package is formed by an in-line process operating on a web of paper or plastic with perforations, cut-outs, and adhesive patterns being made on the web. The window patches are severed from the tape and adhered to the web at spaced intervals along the web so that the sheet is severed from the web and folded. Cards are adhered by an adhesive either to the web or to an adhesive on the face of the plastic window patch, which is then adhered to the web. The severed sheet is folded into configurations such as an "A" fold, a "V" fold, a "Z" fold, a "C" fold, etc., and is sealed by an adhesive pattern on the web to prevent unauthorized access to the card. Authorized access to the card is preferably afforded by lines of weakness such as perforations in the panels of the package. If the package is a phone card, a removable transfer tape may be provided and another opening may be provided in a panel to allow viewing of the indicia on the card. Non-variable indicia is printed on the web and variable indicia may be imaged on the web and/or the card and read therefrom cut-outs in the web.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What is claimed:

1. A phone card package assembly comprising:

a sheet of material having side edges and end edges;

a first panel on the sheet material;

a second panel on the sheet material;

at least one fold line on the sheet material allowing the first and second panels to be folded to overlie one another;

the first panel having a cut-out window therein;

a card of material stiffer than said sheet of material mounted with the card between the first and second panels, the card having first and second faces;

the card overlying the window and mounted on the sheet material to show at least a portion of the first face of the card;

adhesive patterns disposed on at least one of the panels for holding said panels together with the second panel covering the said second face;

tear strips on the sheet material for tearing off to allow access to the card;

a transparent patch of material covering the cut-out window and protecting the first face of the card while exposing at least a portion of the card;

a transfer tracking strip releasably mounted on one of the panels for removal after the sale of the phone card package assembly;

a removable release tape on the tracking strip covering adhesive on the tracking strip for removal to expose the adhesive on the tracking strip;

a third panel formed in the sheet material; and two fold lines being provided in the sheet material to allow folding of the sheet material into three panels.

2. A card package assembly in accordance with claim 1 wherein the third panel is folded between the first and second panels forming a "C"-folded package assembly.

3. A card package assembly comprising:

a sheet of material having side edges and end edges;

a first panel on the sheet material;

a second panel on the sheet material;

at least one fold line on the sheet material allowing the first and second panels to be folded to overlie one another;

the first panel having a cut-out window therein;

a card of material stiffer than said sheet of material mounted with the card between the first and second panels, the card having first and second faces;

the card overlying the window and mounted on the sheet material to show at least a portion of the first face of the card;

adhesive patterns disposed on at least one of the panels for holding said panels together with the second panel covering the card second face;

tear strips on the sheet material for tearing off to allow access to the card;

a transparent patch of material covering the cut-out window and protecting the first face of the card while exposing at least a portion of the card;

a third panel formed in the sheet material;

two fold lines provided in the sheet material to allow folding of the sheet material into three panels; and the second panel being disposed between the first and third panels forming a "Z"-folded package assembly.

4. A card package assembly comprising:

a sheet of material having side edges and end edges;

a first panel on the sheet material;

a second panel on the sheet material;

at least one fold line on the sheet material allowing the first and second panels to be folded to overlie one another;

the first panel having a cut-out window therein;

a card of material stiffer than said sheet of material mounted with the card between the first and second panels, the card having first and second faces;

the card overlying the window and mounted on the sheet material to show at least a portion of the first face of the card;

adhesive patterns disposed on at least one of the panels for holding said panels together with the second panel covering the card second face;

tear strips on the sheet material for tearing off to allow access to the card;

a transparent patch of material covering the cut-out window and protecting the first face of the card while exposing at least a portion of the card; and a card carrier having the card mounted thereon.

5. A card package assembly in accordance with claim 4 wherein the card carrier comprises a pair of panels having a fold line and being folded into a "V" configuration.

6. A card package assembly in accordance with claim 4 wherein a third panel is formed on the sheet material;

two fold lines are provided on the sheet panel to allow folding of the sheet material into a "C"-folded package configuration.

7. A card package assembly in accordance with claim 6 wherein the card carrier is adhered to the middle one of the three panels.

8. A card package in accordance with claim 4 comprising:

a transfer tracking strip releasably mounted on one of the panels for removal after sale of the card package assembly.

9. A card package in accordance with claim 8 comprising:

an adhesive on the tracking strip; and a removable release tape on the tracking strip for removal from the tracking strip to expose the adhesive on the tracking strip.

10. A method of making a folded card package assembly having a card visible behind a transparent window patch covering a cut-out window in a panel of the card package, the method comprising:

providing a printed web of sheet material to be formed into the folded package;

forming cut-out windows in the web of the printed sheet material at predetermined, spaced intervals;

providing a strip of transparent plastic window material;

severing window patches from the strip;

placing the window patches over the cut-out windows in the printed web of sheet material;

adhering the window patches to the sheet material;

mounting the card on the web of the sheet material with the card aligned with the cut-out window to allow viewing of the card;

applying adhesive to the sheet material that will hold the panels together;

severing a package sheet from the web having the card mounted thereon;

folding the severed package sheet into a folded configuration having at least first and second panels and a fold line between the first and second panels; and adhering the panels of the sheet material together to form the final package with the card being located between the panels and visible through the transparent window patch.

11. A method in accordance with claim 10 further comprising a forming of lines of weakness in one of the panels to form a tear strip to allow access to the card upon tearing of the tear strip.

12. A method in accordance with claim 11 further comprising perforating a pair of parallel lines of weakness to form the tear strip.

13. A method in accordance with claim 10 further comprising; a forming of a second fold line in the sheet material to provide a third panel; and folding the three panels into a "Z"-folded configuration.

14. A method in accordance with claim 10 further comprising:

providing the sheet with three panels; and folding the three panels into a "C"-folded configuration with the third panel folded interiorly between the first and second panels.

15. A method in accordance with claim 10 further comprising:

adhering a removable tracking strip to one of said panels for removal after purchase of the card.

16. A method in accordance with claim 10 further comprising:

making a second cut-out window in the web of sheet material to allow viewing of the second face of the card.

17. A method in accordance with claim 10 further comprising:

applying adhesive patterns on the window patch outside of the cut-out window to provide a clear transparent patch material.

18. A method in accordance with claim 10 further comprising:

adhering the card to the transparent, plastic window patch and adhering the window patch to one of said panels.

19. A method in accordance with claim 10 further comprising:

providing fold lines in the first and second panels adjacent ends of the first and second panels to form stand pieces; and bending the stand pieces outwardly to form a stand for the card package.

20. A method in accordance with claim 10 comprising:

mounting the card on a card carrier; and placing the card carrier with the card thereon in the package assembly.

21. A method in accordance with claim 20 comprising:

folding the card carrier into "V"-shaped configuration.

22. A method in accordance with claim 20 comprising:

providing the sheet with three panels; and folding the three panels into a "C" configuration with the card carrier mounted within the "C" configuration package assembly.

23. A method in accordance with claim 22 comprising:

adhering the card to the card carrier; and adhering the card carrier to one of the three panels.

24. A card package assembly comprising:

a sheet of material having side edges and end edges;

a interior end panel on one end of the sheet material;

an exterior end panel on another end of the sheet material;

an intermediate panel on the sheet material being disposed intermediate the interior and exterior end panels;

two fold lines on the sheet material between the intermediate panel and the respective interior and exterior end panels allowing these respective end panels to be folded related to the intermediate panel and jointed thereto on opposite ends of the intermediate panel;

one of the panels having a cut-out window therein;

a card of material stiffer than said sheet of material mounted with the card positioned interiorly between the exterior panel and the intermediate panel, the card having first and second faces;

the card overlying the window and mounted on the sheet material to show at least a portion of the first face of the card;

adhesive patterns disposed on at least one of the panels for holding said panels together;

tear strips on the sheet material for tearing off to allow access to the card;

a transparent patch of material covering the cut-out window and protecting the first face of the card while exposing at least a portion of the card; and the interior end panel being folded and positioned between the intermediate panel and the exterior end panel and being covered by the intermediate and the exterior end panel thereby forming a "C"-folded package assembly having at least a portion of the card being exposed through the transparent patch and the cut-out window.

25. A card package in accordance with claim 24 wherein the interior end panel is shorter in height than the intermediate panel.

26. A card package in accordance with claim 24 wherein a card carrier has the card mounted thereon; and the card carrier is mounted in the interior of the "C"-folded package assembly.

27. A card package in accordance with claim 24 wherein the window and patch are in the exterior end panel; and the card is mounted on the interior end panel and is interior with the intermediate panel.

28. A card package in accordance with claim 24 wherein the window and transparent patch are on the intermediate panel.

* * * * *

UNITED STATES PATENT AND TRADEMARK OFFICE

CERTIFICATE OF CORRECTION

PATENT NO. : 6,349,829
DATED : February 26, 2002
INVENTOR(S) : Mark Mantheis et al.

It is certified that error appears in the above-identified patent and that said Letters Patent is hereby corrected as shown below:

Column 12,
Line 41, change "said" to -- card --.

Signed and Sealed this

Twenty-first Day of May, 2002

*Attest:*

*Attesting Officer*

JAMES E. ROGAN
*Director of the United States Patent and Trademark Office*